United States Patent [19]

Streicher et al.

[11] Patent Number: 4,983,185

[45] Date of Patent: Jan. 8, 1991

[54] DYEING OF LEATHER WITH PIGMENTS

[75] Inventors: Rolf Streicher, Worms; Ortwin Schaffer, Ludwigshafen; Horst Belde, Lugwigshafen; Paul Guenthert, Schifferstadt, all of Fed. Rep. of Germany

[73] Assignee: BASF Aktiengesellschaft, Ludwigshafen, Fed. Rep. of Germany

[21] Appl. No.: 357,712

[22] Filed: May 26, 1989

[30] Foreign Application Priority Data

May 28, 1988 [DE] Fed. Rep. of Germany ..... 3818183

[51] Int. Cl.[5] ..... D06P 3/60

[52] U.S. Cl. ..... 8/436; 8/404

[58] Field of Search ..... 8/404, 436

[56] References Cited

U.S. PATENT DOCUMENTS 2,893,811 7/1959 Kirk ..... 8/437

3,841,888 10/1974 Belde et al. ..... 106/288 Q 4,272,243 6/1981 Lach et al. ..... 8/436

FOREIGN PATENT DOCUMENTS 0005463 7/1984 United Kingdom ..... 8/436

OTHER PUBLICATIONS

Ullamanns Encyklopadie der Technischen Chemie, 4th Edition, Band 22, p. 488.

K. Lindner, Tenside-Textilhilfsmittel-Waschrohstoffe Band 1, p. 963 et seg., 1964.

K. Lindner, Tenside-Textilhilfsmittel-Waschrohstoffe Band 1, p. 837 et seg., 1964.

*Primary Examiner*—Paul Lieberman

*Assistant Examiner*—John F. McNally

*Attorney, Agent, or Firm*—Oblon, Spivak, McClelland, Maier & Neustadt

[57] ABSTRACT

Leather is dyed with pigments in an aqueous liquor at from 20° to 60° C. in the presence of an alkoxylated amine of 20 or more carbon atoms.

5 Claims, No Drawings

DYEING OF LEATHER WITH PIGMENTS

The present invention relates to a novel process for dyeing leather with pigments wherein the dyeing is carried out in the presence of an alkoxylated amine, said amine having 20 or more carbon atoms.

The colorants used in the dyeing of leather are customarily dyes. However, leather which has been dyed with dyes frequently has application defects, for example insufficient lightfastness or inadequate coloring of faulty grain.

If pigments are used as the colorants, the dyeings obtained on leather have in general a good lightfastness. However, it has been found that the distribution of the pigments is poor, in particular on the surface as well as over the cross-section of the leather. The pigments preferentially end up on the leather on the flesh side and in open faulty grain. The hair holes are frequently left undyed.

However, today there are many types of leather, for example upholstery leather, apparel leather or special upper leathers, where good penetration of the dye is demanded.

It is an object of the present invention to provide a process for dyeing leather with pigment colorants which produces a uniformly dyed surface and, in the case of thin leathers, good penetration of the leather as well.

We have found that this object is achieved in an advantageous manner by treating the leather in an aqueous liquor at from 20° to 60° C. with pigments in the presence of an alkoxylated amine of 20 or more carbon atoms.

Alkoxylated amines of 20 or more carbon atoms suitable for the purposes of the process according to the invention are secondary and tertiary amines which have hydrocarbon radicals which are saturated or unsaturated and one or more of which is interrupted by one or more oxygen atoms. These hydrocarbon radicals are linear, branched or cyclic and may be interrupted by one or more imino groups and/or substituted by hydroxyl.

These amines can be obtained for example by reacting $C_1$-$C_{30}$-alkylamines, $C_3$-$C_{30}$-alkenylamines or $C_2$-$C_{30}$-hydroxylalkylamines with alkylene oxides of the formula I

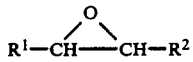

(I)

where $R^1$ and $R^2$ are identical or different and each is independently of the other hydrogen, methyl or ethyl.

They can also be obtained for example by reacting polyamines of the formula II

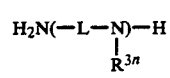

(II)

where L is $C_2$-$C_8$-alkylene (for example ethylene, 1,2-propylene or 1,2- or 1,4-butylene), $R^3$ is hydrogen or $C_1$-$C_8$-alkyl, and n is from 1 to 5, preferably from 1 to 3, or aromatic or cycloaromatic diamines with alkylene oxides of the abovementioned formula I.

The maximum number of carbon atoms in the alkoxylated amines to be used according to the invention depends on the number of moles of identical or different alkylene oxides of the formula I involved in the alkoxylation and is frequently impossible to specify precisely, but the upper limit of the molecular weights of the alkoxylated amines is customarily around 30,000.

The process according to the invention is preferably carried out with those alkoxylated amines whose average molecular weight is from 2000 to 20,000, in particular from 4000 to 15,000, especially from 7000 to 13,000.

In the process according to the invention, furthermore, preference is given to using those alkoxylated amines which are derived from the reaction of $C_{12}$-$C_{25}$-alkylamines or $C_{12}$-$C_{25}$-alkenylamines with ethylene oxide and/or propylene oxide.

Preference is further given to the use of alkoxylated amines which are obtained by reaction of polyamines of the formula II or aromatic or cycloaliphatic diamines with from 3 to 50 moles of propylene oxide per equivalent of reactive amino hydrogen and subsequent reaction with from 2 to 70 moles of ethylene oxide per equivalent of reactive amino hydrogen and in which the proportion of terminal polyethylene oxide blocks is from 35 to 80% by weight, preferably from 35 to 45% by weight, in particular about 40% by weight. Such block copolymers have in general an average molecular weight of from 4000 to 15,000, preferably from 11,000 to 15,000.

Suitable amines which can be reacted with alkylene oxides of the formula I are for example methylamine, ethylamine, propylamine, isopropylamine, butylamine, secbutylamine, pentylamine, isopentylamine, neopentylamine, tert-pentylamine, hexylamine, heptylamine, octylamine, 2-ethylhexylamine, nonylamine, decylamine, dodecylamine, tetradecylamine, hexadecylamine, 2-hexyldecylamine, 2-heptyldecylamine, octadecylamine, eicosylamine, 2-octyldodecylamine, docosylamine, hexacosylamine, triacontylamine, octadec-9(cis)-enylamine, octadec-9(trans)-enylamine, octadec-9(cis),12(cis)-dienylamine, octadec-9(cis),12(cis),15(cis)-trienylamine, the technical grade fatty amines cocoamine, tallowamine, oleylamine, n-cocopropylenediamine or n-tallowpropylenediamine, ethanolamine, propanolamine, isopropanolamine, ethylenediamine, diethylenetriamine, 1,2- or 1,3-propylenediamine, di(1,2- or 1,3-propylene)triamine, o-, m- or p-phenylenediamine, toluylenediamines, 1,1-bis(4-aminophenyl)cyclohexane, 1,2- or 1,4-diaminocyclohexane and 4,4'-diaminodicyclohexylmethane.

The amines to be used according to the invention are in general products known per se. In many cases, these products are commercially available. Amines of the type mentioned are described for example in K. Lindner, Tenside-Textilhilfsmittel-Waschrohstoffe, volume 1, pages 963 et seq., 1964.

Pigments suitable for use in the process according to the invention include not only inorganic but also organic pigments, the latter being preferred.

Inorganic pigments used as colorants in the process according to the invention are for example iron oxides, titanium dioxides and carbon blacks.

Organic pigments used as colorants in the process according to the invention are for example those of the class of the monoazo pigments (for example products derived from acetoacetarylide derivatives or from β-naphthol derivatives), laked monoazo dyes, such as laked β-hydroxynaphthoic acid dyes, disazo pigments, fused disazo pigments, isoindoline derivatives, derivatives of naphthalenetetracarboxylic acid or perylenetetracarboxylic acid, anthraquinone pigments, thioindigo derivatives, azomethine derivatives, quinacridones, dioxazines, pyrazoloquinazolones, phthalocyanine pigments or laked basic dyes, such as laked triarylmethane dyes.

Examples are the inorganic pigments Pigment Yellow 42 (C.I. 77 492), Pigment White 6 (C.I. 77 891), Pigment Blue 27 (C.I. 77 510), Pigment Blue 29 (C.I. 77 007), or Pigment Black 7 (C.I. 77 266) and the organic pigments Pigment Yellow 1 (C.I. 11 680), Pigment Yellow 3 (C.I. 11 710), Pigment Yellow 16 (C.I. 20 040), Pigment Yellow 17 (C.I. 21 705), Pigment Yellow 42 (C.I. 77 492), Pigment Yellow 74 (C.I. 11 741), Pigment Yellow 83 (C.I. 21 108), Pigment Yellow 106, Pigment Yellow 108 (C.I. 68 240), Pigment Yellow 113, Pigment Yellow 117, Pigment Yellow 126, Pigment Yellow 139, Pigment Yellow 185, Pigment Orange 5 (C.I. 12 075), Pigment Orange 13 (C.I. 21 110), Pigment Orange 34 (C.I. 21 115), Pigment Orange 36 (C.I. 11 780), Pigment Orange 43 (C.I. 71 105), Pigment Orange 67, Pigment Red 3 (C.I. 12 120), Pigment Red 48:1 (C.I. 15 865:1), Pigment Red 48:4 (15 865:4), Pigment Red 101 (C.I. 77 491), Pigment Red 112 (C.I. 12 370), Pigment Red 122 (C.I. 73 915), Pigment Red 123 (C.I. 71 145), Pigment Red 146 (C.I. 12 485), Pigment Red 169 (C.I. 45 160:2), Pigment Red 170, Pigment Violet 19 (C.I. 46 500), Pigment Violet 23 (C.I. 51 319), Pigment Violet 27 (C.I. 42 555:3), Pigment Blue 1 (C.I. 42 595:2), Pigment Blue 15 : 1 (C.I. 74 160), Pigment Blue 15 : 3 (C.I. 74 160), Pigment Blue 61 [C.I. 42 765:1), Pigment Green 7 (C.I. 74 260), Pigment Green 8 (C.I. 10 008) or Pigment Green 36 (C.I. 74 265).

The alkoxylated amines are used for example in an amount of from 0.1 to 5%, preferably from 0.3 to 3%, in particular from 0.3 to 2%, based on the moist weight of the leather to be dyed. An increase in the amount of amine is possible. However, it does not produce any further benefits.

The pigments are used for example in an amount of from 0.02 to 4%, based on the moist weight of the leather to be dyed.

Organic pigments are preferably used in an amount of from 0.1 to 2%, in particular from 0.2 to 1%, of pigment, based on the moist weight of the leather to be dyed. In the case of inorganic pigments, the amount used is preferably from 0.2 to 4%, in particular from 0.4 to 2%, based on the moist weight of the leather to be dyed.

Leather suitable for dyeing is in general commercial mineral-tanned leather, ie. leather tanned for example on the basis of the metals chromium, aluminum, titanium or zirconium. Such leather types are used for example for the production of leather apparel, as upholstery leather or as upper leather.

We have further found that, if the treatment of the leather with the pigment is additionally carried out in the presence of an alkoxylated alcohol of 16 or more carbon atoms, very favorable dyeing results are obtained.

Alkoxylated alcohols suitable for the purposes of the process according to the invention are those alcohols which have a hydrocarbon radical which is saturated or unsaturated and interrupted by one or more oxygen atoms. This hydrocarbon radical is linear, branched or cyclic and may be substituted by further hydroxyl groups.

These alcohols can be obtained for example by reacting $C_1$-$C_{30}$-alkanols, $C_3$-$C_{30}$-alkenols or $C_2$-$C_{30}$-alkanepolyols with alkylene oxides of the formula I.

In the process according to the invention, preference is given to using those alkoxylated alcohols which are derived from the reaction of $C_{10}$-$C_{20}$-alkanols, $C_{10}$-$C_{20}$-alkenols or $C_2$-$C_6$-alkanepolyols with ethylene oxide and/or propylene oxide.

The maximum number of carbon atoms in the alkoxylated alcohols to be used according to the invention depends on the number of moles of identical or different alkylene oxides of the formula I involved in the alkoxylation and is frequently impossible to specify precisely, but the upper limit of the molecular weights of the alkoxylated alcohols is customarily around 10,000.

The process according to the invention is preferably carried out with those alkoxylated alcohols whose molecular weight is from 300 to 2000, in particular from 500 to 1500.

Suitable alcohols which can be reacted with alkylene oxides of the formula I are for example methanol, ethanol, propanol, isopropanol, butanol, isobutanol, pentanol, isopentanol, neopentanol, hexanol, heptanol, octanol, 2-ethylhexanol, nonanol, decanol, 2-propylheptanol, dodecanol, 2-butyloctanol, tetradecanol, 2-pentylnonanol, hexadecanol, octadecanol, eicosanol, tetracosanol, hexacosanol, octacosanol, tricosanol, octadec-9(cis)-enol, octadec-9(trans)-enol, octadec-9(cis), 12(cis)-dienol, octadec-9(cis),12(cis),15(cis)-trienol, eicosa-5,8,11,14-tetraenol,ethane-1,2-diol, propane-1,2-or-1.3-diol, butane-1,2-, -1,3-, -1,4- or -2,3-diol, hexane-1,6-diol, octadec-9(cis)-ene-1,12-diol, glycerol, trimethylolethane, trimethylolpropane, hexane-1,2,5- or-1,2,6-triol, 3-hydroxymethylpentane-2,4-diol, erythritol, pentaerythritol, dipentaerythritol, mannitol or sorbitol or technical grade fatty alcohols, such as tallow fat alcohol.

The alkoxylated alcohols to be used according to the invention are in general products known per se. In many cases, these products are commercially available. Alcohols of the type mentioned are described for example in K. Lindner, Tenside-Textilhilfsmittel-Waschrohstoffe, volume 1, pages 837 et seq., 1964, or in Ullmanns Enzyklopädie der technischen Chemie, 4th edition, volume 22, pages 488 et seq.

The alkoxylated alcohols are used for example in an amount of from 0.1 to 5% by weight, preferably from 0.3 to 3% by weight, in particular from 0.2 to 2% by weight, based on the leather to be dyed.

The pigments to be used as colorants in the novel process can conveniently be used in the form of conventional pigment preparations, for example in the form of aqueous dispersions. Of these aqueous pigment preparations, those are preferred which contain nonionic surfactants as dispersing aids. Suitable nonionic surfactants are for example the above-identified components to be used according to the invention or else addition products of alkylene oxides on fatty acids, phenols, alkylphenols, amides or mercaptans.

Particular emphasis must be given to those aqueous pigment preparations which contain as the dispersing aid an alkoxylated amine of 20 or more carbon atoms. They are described for example in DE-A-2,156,603.

We have found that pigments of a particle size of less than 1 $\mu$m, for example of from 0.01 to 0.2 $\mu$m, give particularly favorable results.

A preferred procedure comprises treating the leather with an aqueous pigment preparation which contains an alkoxylated amine of 20 or more carbon atoms as a dispersing aid.

A particularly preferred procedure comprises effecting the treatment of the leather with an aqueous pigment preparation which contains an alkoxylated amine in the presence of additional alkoxylated amine.

Very particular preference is given to a procedure where the treatment of the leather is carried out with an aqueous pigment preparation which contains an alkoxylated amine in the presence of additional alkoxylated amine and an alkoxylated alcohol of 16 or more carbon atoms.

The process according to the invention is advantageously carried out by introducing a conventionally pretreated leather into a drum, in an aqueous liquor, and at from 20° to 60° C., preferably from 40° to 50° C., adding the pigment as described above, preferably in the form of an aqueous preparation which contains an alkoxylated amine dispersant with or without additional alkoxylated amine and with or without alkoxylated alcohol. The dyeing of the leather is then performed at the abovementioned temperature and at a pH of from 4 to 7, preferably from 4.5 to 6, by drumming. The dyeing process is in general complete after from 0.5 to 2 hours. Following a conventional fixation with formic acid the leather is removed from the dyeing liquor, washed with water and worked up in a conventional manner.

The process according to the invention can also be carried out in the presence of further assistants or additives customary in leather dyeing, for example commercial salts of condensation products of phenolsulfonic or naphthalenesulfonic acids with formaldehyde and urea or fat liquors based on emulsified paraffins or acrylate-based water-soluble polymers having a molecular weight of from about 2000 to 5000.

These customary assistants or additives may be added to the aqueous liquor either before the dyeing process or together with the pigment and the alkoxylated amine.

In particular with the dyeing of upholstery leather it can be of advantage in some cases to carry out the dyeing process in two stages by subjecting the upholstery leather which has been treated once with pigments to a further dyeing with pigments in a second stage, the pigment content of the second dyeing liquor being in general lower than that of the first liquor.

We have found that particularly advantageous leather dyeings are obtained on carrying out the process according to the invention additionally in the presence of one or more water-soluble acid dyes.

Suitable water-soluble acid dyes are for example known sulfo-containing metal-free or metal complex azo dyes, sulfo-containing metal phthalocyanines or sulfo-containing anthraquinones.

The water-soluble acid dyes are advantageously added to the dyeing liquor in powder form or in the form of a liquid preparation. They are advantageously added together with the pigment.

In general, from 0.1 to 6%, preferably from 0.5 to 5%, in particular from 0.5 to 3%, based on the moist weight of the leather to be dyed, of water-soluble acid dye is used.

In the process according to the invention, the leather can be treated not only with individual pigments but also with mixtures of pigments. Preference here is given to dyeing the leather with a mixture of yellow, red and blue pigments, which gives rise to brown shades.

The novel process makes it possible to obtain leather dyeings which are notable for excellent levelness, depth of shade, brilliance and high lightfastness, wetfastness and migration fastness properties. In addition, they show good penetration of color.

The Examples will explain the invention in more detail. Percentages are by weight and relate to shaved chrome leather.

The pigments used in the Examples were each used in the form of an aqueous preparation containing as the alkoxylated amine a reaction product of ethylenediamine with first propylene oxide and then ethylene oxide (ethylene oxide content: 40%; $\overline{M}$ 10,500) Based on the weight of the pigment, the amine was 20%.

The acid dyes found a the form of an aqueous solution.

The alkoxylated amine is oleylamine ethoxylated with about 10-moles of ethylene . The alkoxylated alcohol is tallow fat alcohol with about 80 moles of ethylene oxide.

(A) Dyeing of upholstery leather

General dyeing method

Pretreatment

Upholstery leather was conventionally retanned and then washed

Dyeing stage 1

Upholstery leather was at 50° C. in 200% of an aqueous liquor containing 1 ammonia for 10 minutes. To the dyeing liquor was then added pigment, any acid dye to be used, alkoxylated amine and alkoxylated alcohol. The leather was then for 30 minutes, 10% of a commercial fat liquor added, and drumming was continued for a further 60 minutes. 2.5% of formic acid was then added in two port separated by 15 minutes, and the leather was drummed for a further 30 minutes. The dyeing liquor was then dropped.

Dyeing stage 2

The leather was then at 50° C. in 200% of dyeing liquor containing dye, alkoxylated amine and alkoxylated alcohol for 30 minutes. 1% of formic acid was added, and continued for a further 30 minutes.

Postfixation

The leather was then from the liquor and drummed for 5 minutes at 40° C. 200% of an aqueous liquor containing 0.3 of acid. 0.3% of a commercial cationic postfixation aid was then added, and drumming was continued for a further 30 minutes. The leather was then worked up in a conventional manner, ie. by wet stretching, drying, moistening and milling.

EXAMPLE 1

Dyeing stage 1
1.0% of C.I. Pigment Red 146
1.0% of C.I. Acid Red 310
1.5% of C.I. Acid Red 282
0.3% of alkoxylated amine
0.35% of alkoxylated alcohol
Dyeing stage 2
0.5% of C.I. Pigment Red 146
0.5% of C.I. Acid Red 310
0.75% of C.I. Acid Red 282
0.15% of alkoxylated amine
0.18% of alkoxylated alcohol
Shade of dyed leather: red

EXAMPLE 2

Dyeing stage 1
0.5% of copper phthalocyanine (α-modification)

0.5% of C.I. Vat Violet 9
1.0% of C.I. Acid Blue 134
1.0% of C.I. Acid Blue 54
0.3% of alkoxylated amine
0.35% of alkoxylated alcohol
Dyeing stage 2
0.25% of copper phthalocyanine (α-modification)
0.25% of C.I. Vat Violet 9
0.5% of C.I. Acid Blue 134
0.5% of C.I. Acid Blue 254
0.15% of alkoxylated amine
0.18% of alkoxylated alcohol
Shade of dyed leather: blue.

EXAMPLE 3

The procedure was in accordance with the general dyeing method, except that it did not involve a stage 2.
0.8% of C.I. Pigment Orange 13
3.0% of C.I. Acid Brown 422
0.3% of alkoxylated amine
0.35% of alkoxylated alcohol
Shade of dyed leather: yellowish brown.

EXAMPLE 4

The procedure was similar to Example 3.
1.5% of C.I. Pigment Orange 13
0.3% of alkoxylated amine
0.35% of alkoxylated alcohol
Shade of dyed leather: brown
(B) Dyeing of upper leather
General dyeing method
Pretreatment Upper leather was conventionally retanned with a polymer tanning agent based on acrylic acid/acrylonitrile, an amphoteric tanning agent based on a condensation product of phenolsulfonic acid and formaldehyde and a resin tanning agent based on a condensation product of melamine and formaldehyde, and then washed.

Dyeing stage

The retanned leather was drummed for 40 minutes at 55° C. in 150% of an aqueous liquor containing pigment, acid dye, alkoxylated amine and any alkoxylated alcohol to be used. 6% of commercial fat liquor was then added, and drumming was continued for 40 minutes. Finally, 1% of formic acid was added in 2 portions, the addition of the 1st portion being followed by 20 minutes' drumming and that of the 2nd portion by 30 minutes' drumming. The leather was then removed from the liquor and worked up in a conventional manner, ie. by drying under reduced pressure, moistening and staking.

EXAMPLE 5

0.23% of C.I. Pigment Yellow 83
0.2% of C.I. Pigment Red 146
0.04% of copper phthalocyanine (α-modification)
0.04% of C.I. Vat Violet 9
2.0% of C.I. Acid Brown 434
0.1% of alkoxylated amine
0.1% of alkoxylated alcohol
Shade of dyed leather: brown.

EXAMPLE 6

0.25% of C.I. Pigment Yellow 83
0.15% of C.I. Pigment Red 146
0.05% of copper phthalocyanine (α-modification)
0.05% of C.I. Vat Violet 9
2.0% of C.I. Acid Brown 290
0.1% of alkoxylated amine
0.1% of alkoxylated alcohol
Shade of dyed leather: brown.

EXAMPLE 7

0.23% of C.I. Pigment Yellow 83
0.2% of C.I. Pigment Red 146
0.04% of copper phthalocyanine (α-modification)
0.04% of C.I. Vat Violet 9
2.0% of C.I. Acid Brown 434
0.3% of alkoxylated amine
Shade of dyed leather: brown.

Examples 1 to 7 each produced a level dyeing on the leather in a bright shade and with a high lightfastness.

We claim:

1. A process for dyeing leather with a pigment in an aqueous liquor, which comprises treating the leather at from 20° to 60° C. with a pigment in the presence of an alkoxylated amine of 20 or more carbon atoms wherein the amine is a secondary or tertiary amine which has hydrocarbon radicals which are saturated or unsaturated and one or more of which is interrupted by one or more oxygen atoms.

2. A process for dyeing leather as claimed in claim 1, wherein the leather is treated with from 0.1 to 5%, based on the moist weight of the leather to be dyed, of an alkoxylated amine.

3. A process for dyeing leather as claimed in claim 1, wherein the treatment is additionally carried out in the presence of an alkoxylated alcohol of 16 or more carbon atoms wherein the alcohol has a hydrocarbon radical which is saturated or unsaturated and interrupted by one or more oxygen atoms.

4. A process for dyeing leather as claimed in claim 1, wherein the treatment is carried out with an aqueous pigment preparation which contains an alkoxylated amine of 20 or more carbon atoms.

5. A process for dyeing leather as claimed in claim 1, wherein the treatment is additionally carried out in the presence of a water-soluble acid dye.

* * * * *